US008950193B2

(12) United States Patent
Radebaugh et al.

(10) Patent No.: US 8,950,193 B2
(45) Date of Patent: Feb. 10, 2015

(54) SECONDARY PULSE TUBES AND REGENERATORS FOR COUPLING TO ROOM TEMPERATURE PHASE SHIFTERS IN MULTISTAGE PULSE TUBE CRYOCOOLERS

(75) Inventors: Ray Radebaugh, Louisville, CO (US); Isaac Garaway, Kfar Tavor (IL); Peter E. Bradley, Lakewood, CO (US)

(73) Assignee: The United States of America, as Represented by the Secretary of Commerce, the National Institute of Standards and Technology, Washington, DC (US)

( * ) Notice: Subject to any disclaimer, the term of this patent is extended or adjusted under 35 U.S.C. 154(b) by 1081 days.

(21) Appl. No.: 13/012,040

(22) Filed: Jan. 24, 2011

(65) Prior Publication Data

US 2012/0151941 A1 Jun. 21, 2012

(51) Int. Cl.

| | |
|---|---|
| ***F25B 9/00*** | (2006.01) |
| ***F25B 9/14*** | (2006.01) |
| ***F25B 9/10*** | (2006.01) |
| *F25B 9/06* | (2006.01) |

(52) U.S. Cl.

CPC ..... *F25B 9/145* (2013.01); *F25B 2309/1406* (2013.01); *F25B 2309/1411* (2013.01); *F25B 9/06* (2013.01); *F25B 2309/1426* (2013.01); *F25B 2309/1413* (2013.01); *F25B 2309/1407* (2013.01); *F25B 9/10* (2013.01)

USPC ..... 62/6

(58) Field of Classification Search

CPC .... F25B 9/06; F25B 9/145; F25B 2309/1406; F25B 2309/1407; F25B 2309/1421; F25B 2309/1426

USPC ..... 62/6

See application file for complete search history.

(56) References Cited

U.S. PATENT DOCUMENTS

| | | | | |
|---|---|---|---|---|
| 5,275,002 | A * | 1/1994 | Inoue et al. | 62/6 |
| 5,435,136 | A * | 7/1995 | Ishizaki et al. | 60/517 |
| 5,513,498 | A | 5/1996 | Ackermann et al. | |
| 6,205,812 | B1 | 3/2001 | Acharya et al. | |
| 6,389,819 | B1 | 5/2002 | Zhu et al. | |
| 6,622,491 | B2 | 9/2003 | Hofmann | |

(Continued)

FOREIGN PATENT DOCUMENTS

WO 2009/124132 A1 10/2009

OTHER PUBLICATIONS

Radebaugh et al. Secondary Pulse Tubes and Regenerators for Coupling to Room-Temperature Phase Shifters in Multistage Pulse Tube Cryocoolers. Proceedings of the 16th International Cryocooler Conference, held May 17-20, 2008 in Atlanta, Georgia. Taken from https://smartech.gatech.edu/handle/1853/38783.*

(Continued)

*Primary Examiner* — John F Pettitt

*Assistant Examiner* — Tareq Alosh

(74) *Attorney, Agent, or Firm* — Mark E. Bandy; Rankin, Hill & Clark LLP

(57) ABSTRACT

Pulse tube refrigeration or cooling systems are described which utilize a secondary regenerator or a secondary pulse tube. Use of such a secondary regenerator or pulse tube enables a commercially available pressure oscillator to be incorporated in the cooling system. The commercially available oscillator can be operated at room temperature or approximately so.

9 Claims, 6 Drawing Sheets

(56) References Cited

U.S. PATENT DOCUMENTS

| | | | |
|---|---|---|---|
| 6,644,038 | B1 | 11/2003 | Acharya et al. |
| 6,658,862 | B2 | 12/2003 | Swift et al. |
| 7,162,877 | B2 | 1/2007 | Daniels |

OTHER PUBLICATIONS

Ray Radebaugh, "Development of the Pulse Tube Refrigerator as an Efficient and Reliable Cryocooler", Proc. Institute of Refrigeration, 1999-2000, pp. 1-27, London.

R. Radebaugh et al., "Secondary Pulse Tubes and Regenerators for Coupling to Room-Temperature Phase Shifters in Multistage Pulse Tube Cryocoolers", Cryocoolers 16, 2011, pp. 237-247.

P. E. Bradley et al., "Progress in the Development and Performance of a High Frequency 4 K Stirling-Type Pulse Tube Cryocooler", Cryocoolers 16, 2011, pp. 27-33.

I. Garaway et al., "Measured and Calculated Performance of a High Frequency, 4 K Stage, He-3 Regenerator", Cryocoolers 16, 2011, pp. 405-410.

Peter Kittel, "A Short History of Pulse Tube Refrigerators", website http://ranier.hq.nasa.gov/Sensors_page/Cryo/CryoPT/CryoPTHist.html, Sep. 23, 2010, pp. 1-4.

Wikipedia, "Pulse tube refrigerator", website http://en.wikipedia.org/wiki/Pulse_tube_refrigerator, Sep. 23, 2010, pp. 1-7.

Radebaugh, R.; O'Gallagher, A.; Gary, J.; "Secondary Pulse Tubes and Regenerators for Coupling to Room-Temperature Phase Shifters in Multistage PulSe Tube Cryocoolers"; National Institute of Standards and Technology; Boulder, Co. (Single page abstract).

Radebaugh, R.; O'Gallagher, A.; Gary, J.; "Secondary Pulse Tubes and Regenerators for Coupling to Room-Temperature Phase Shifters in Multistage PulSe Tube Cryocoolers"; 16th International Cryocooler Conference; Atlanta, Ga.; May 18, 2010. (20 pages).

Radebaugh, R.; O'Gallagher, A.; Gary, J.; "Secondary Pulse Tubes and Regenerators for Coupling to Room-Temperature Phase Shifters in Multistage PulSe Tube Cryocoolers"; Cryocoolers 16 (2011), Boulder, pp. 237-247.

* cited by examiner

SECONDARY PULSE TUBES AND REGENERATORS FOR COUPLING TO ROOM TEMPERATURE PHASE SHIFTERS IN MULTISTAGE PULSE TUBE CRYOCOOLERS

FIELD OF THE INVENTION

The present invention relates to pulse tube cooling systems, and particularly, room temperature operation of pressure oscillators used in such systems.

BACKGROUND OF THE INVENTION

Small 4 K cryocoolers for the cooling of low temperature superconducting (LTS) electronic systems are necessary for broader commercial, military, or space applications of such devices. Typically these cryocoolers have been either Gifford-McMahon (GM) cryocoolers or GM-type pulse tube cryocoolers that operate at frequencies of about 1 Hz. The efficiency of these cryocoolers ranges from 0.5 to 1.0% of Carnot, whereas 80 K cryocoolers often achieve efficiencies of about 15% of Carnot. The low efficiency of 4 K cryocoolers causes these cryocoolers to have large, noisy compressors with high input powers. The low operating frequency of the GM and GM-type pulse tubes also leads to large temperature oscillations at the cold end at the operating frequency of the cryocooler. The amplitude of the temperature oscillation decreases inversely with the cryocooler operating frequency.

Higher operating frequencies allow the use of Stirling cryocoolers or Stirling-type pulse tube cryocoolers, which have much higher efficiencies in converting electrical power to PV power. These frequencies are typically in the range of 30 to 60 Hz. The linear Stirling-type compressors (pressure oscillators) often use flexure bearings that eliminate rubbing contact and operate almost silently. However, these higher frequencies generally lead to greater losses in a 4 K regenerator unless the operating parameters are near optimum conditions. Recent regenerator modeling efforts have shown that the phase angle between flow and pressure at the cold end has a strong effect on the 4 K regenerator second law efficiency. In order to achieve an optimum phase of about −30° (flow lagging pressure) at the cold end, a phase of about −60° at the pulse tube warm end is required. Inertance tubes are typically used for phase shifting, but with the small refrigeration powers of interest for electronics cooling, phase shifts of only a few degrees are possible at 30 Hz, even with the inertance tube and reservoir at a low temperature of 30 K. A double inlet configuration with a secondary orifice between the regenerator and pulse tube warm ends can only provide a practical phase shift of about 30° before the lost work in the secondary orifice greatly reduces the overall efficiency. The double inlet approach also introduces the possibility of DC flow, which can reduce the efficiency.

Larger phase shifts with small acoustic powers can be achieved by the use of a warm expander or warm displacer at the warm end of the pulse tube. For single stage pulse tube cryocoolers or for two-stage pulse tube cryocoolers operating at about 1 Hz (GM-type), the warm end of the pulse tube operates at ambient temperature. A 4 K pulse tube may need to have the warm end at 30 K or lower to keep the efficiency of the pulse tube component high, at least for a high frequency of about 30 Hz. It would then be necessary to develop an expander that can operate at about 30 K.

In view of the foregoing, it would be desirable to provide a pulse tube refrigeration system having a room temperature phase shifter or expander.

SUMMARY OF THE INVENTION

The difficulties and drawbacks associated with previously known systems are addressed in the present invention systems and methods.

In one aspect, the present invention provides a pulse tube refrigeration system comprising a compressor, a regenerator in fluid communication with the compressor, and a pulse tube defining a cold end and a warm end. The regenerator is in fluid communication with the cold end of the pulse tube. The system also comprises a secondary component selected from (i) a secondary regenerator and (ii) a secondary pulse tube, wherein the secondary component is in fluid communication with the warm end of the pulse tube. And, the system comprises an expander in fluid communication with the warm end of the secondary component.

In another aspect, the present invention provides a pulse tube cooling system comprising at least one of (i) a cryocooler and (ii) a compressor, and a pulse tube in fluid communication with the at least one of (i) the cryocooler and (ii) the compressor. The pulse tube has a cold end and a warm end. The system also comprises an ambient temperature phase shifter component. And, the system comprises a secondary component selected from (i) a secondary regenerator and (ii) a secondary pulse tube. The secondary component is in fluid communication with, and disposed between, the warm end of the pulse tube and the phase shifter component at some higher temperature (nominally at ambient temperature).

In still another aspect, the invention provides a method for using a phase shifter at ambient temperature in a multistage pulse tube cooling system. The pulse tube cooling system includes a compressor, a regenerator, a pulse tube having a cold end and a warm end at sub-ambient temperature, and the phase shifter at ambient temperature. The method comprises providing a secondary component selected from (i) a secondary regenerator and (ii) a secondary pulse tube. The method also comprises establishing fluid communication between the secondary component and the warm end of the pulse tube at sub-ambient temperature. Upon operation of the cooling system, the phase shifter is at ambient temperature.

As will be realized, the invention is capable of other and different embodiments and its several details are capable of modifications in various respects, all without departing from the invention. Accordingly, the drawings and description are to be regarded as illustrative and not restrictive.

DETAILED DESCRIPTION OF THE EMBODIMENTS

Figure 1:
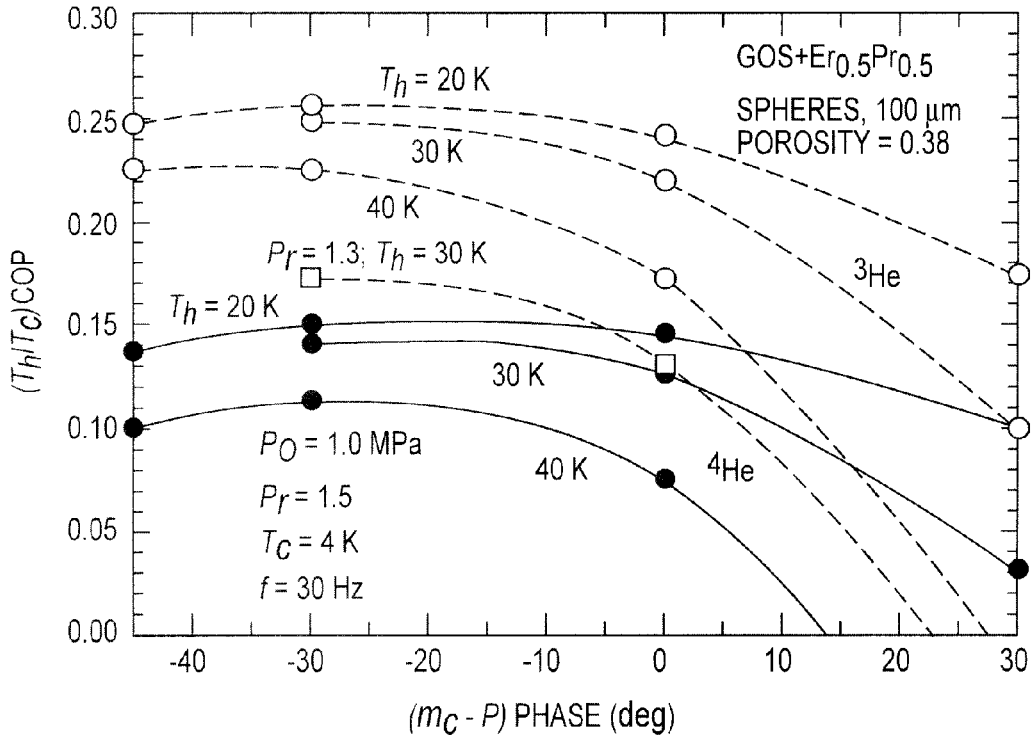
FIG. 1 is a graph of calculated effects of cold end phase on 4 K generators.

The present invention is based, at least in part, upon a discovery that by incorporating a secondary regenerator or a secondary pulse tube at a warm end (but still below room temperature) of a pulse tube, a phase shifter or expander in a pulse tube cooling system can be operated at room temperature. Furthermore, it has been discovered that a wide array of commercially available pressure oscillators can be used for the room temperature phase shifter or expander. These and other aspects are described in greater detail herein.

Generally, multistage pulse tube cryocoolers require separate phase shifters for each stage. For sufficiently high frequency and acoustic power, an inertance tube is typically used for such phase shifting. For Stirling-type multistage pulse tube cryocoolers, the warm end of the coldest pulse tube is often heat sunk to the cold end of a warmer stage rather than at room temperature to improve the figure of merit for the pulse tube and/or to achieve a larger phase shift with a cold inertance tube. The use of a secondary pulse tube or regenerator between the main pulse tube and a phase shifter allows the phase shifter to operate at room temperature where space is more readily available. The use of a secondary pulse tube or regenerator also allows for the use of commercially available pressure oscillators as expanders. The secondary regenerator amplifies the acoustic power, so that a room temperature inertance tube may perform as well as a cold one. A secondary pulse tube transfers acoustic power to room temperature without amplification, so a rather small warm expander or displacer can provide the optimum phase shift even in a low-power cryocooler. As described herein, the behavior of these secondary pulse tubes and regenerators was investigated to determine the optimum geometry and the optimum characteristics for the expander.

In the descriptions herein, references are repeatedly made to a "cold end" of a component or region in a cooling system. Typically, this is the location at which the lowest temperatures are achieved. For many of the systems described herein, the cold end is the end of a pulse tube used in the system and which may reach temperatures as low as about 4 K. It will be understood that in no way is the present invention limited to such temperatures nor to cooling systems providing such temperatures. Instead, it will be understood that the references to 4 K are merely representative. Furthermore, it will be appreciated that various references to 30 K are not limiting. These temperatures are merely noted to provide a better understanding of the subject matter and invention.

Effect of Phase on 4 K Regenerator Performance

Regenerative Cryocooler Losses

The coefficient of performance (COP) of a regenerator is given by formula (1):

$$COP = \frac{\dot{Q}_{net}}{\langle P\dot{V}\rangle_h}, \tag{1}$$

where $\dot{Q}_{net}$ the net refrigeration power at the cold end, and $\langle P\dot{V}\rangle_h$ is the time-averaged acoustic or PV power at the hot end of the regenerator. For an ideal gas and a perfect regenerator, the ideal COP for a regenerator is given by $(T_c/T_h)$, where the reversible expansion work at the cold end is assumed to not be fed back to the hot end of the regenerator. Thus, the thermodynamic second law efficiency of the regenerator is given by formula (2):

$$\eta=(T_h/T_c)\mathrm{COP}. \tag{2}$$

Calculations of the COP and efficiency of 4 K regenerators at 30 Hz were carried out using a publically available software package designated as REGEN3.3 and available from the present assignee. The losses considered in calculating the COP were the real gas effects, the regenerator ineffectiveness, and conduction in the matrix. No pulse tube losses were considered, but in practice they are believed to be approximately 20% to 30% of the gross refrigeration power available at the cold end. It was determined that the phase angle $\phi_c$ between the flow and pressure at the cold end has a strong effect on the regenerator efficiency, as shown in FIG. 1. In this figure a positive phase angle indicates flow leads the pressure. The parameters used in these calculations were optimized for 30 Hz operation with $^3$He working gas. An efficiency of at least 0.10 to 0.15 would be required to overcome any losses within the pulse tube. As shown in FIG. 1, it would be very difficult to reach 4 K with $^4$He when the pressure ratio is 1.5 and the hot end is hotter than about 20 K, even with an optimum phase angle of about −30°. Pressure ratios above 1.5 can increase the efficiency some, but such high pressure ratios usually cause the pressure oscillator to operate far from resonance conditions. The use of $^3$He working gas yields considerably higher second law efficiencies for a 4 K regenerator, as shown in FIG. 1. However, even with $^3$He, the ideal phase angle should be about −30°, and no higher than about 0° to achieve reasonable overall efficiency at 4 K when the pulse tube losses are taken into account. A phase angle of about −30° at the cold end gives rise to a 0° phase near the regenerator midpoint. Such a phase angle provides the minimum flow amplitude for a given acoustic power. The regenerator losses are proportional to the flow amplitude, so the amplitude should be minimized to achieve high efficiency. A phase of −30° at the cold end is difficult to achieve with small acoustic powers at 30 Hz. For 4 K superconducting electronic applications, net refrigeration powers of about 0.1 W are required, which can be provided with about 1 W of acoustic power at the cold end.

Phase Shift Mechanisms

Fixed Elements

Orifices and Inertance Tubes

Figure 2A:
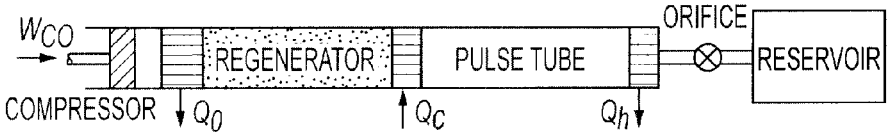
FIGS. 2(*a*)-2(*c*) are schematic illustrations of three known phase shifting methods for pulse tube cryocoolers.
Figure 2B:
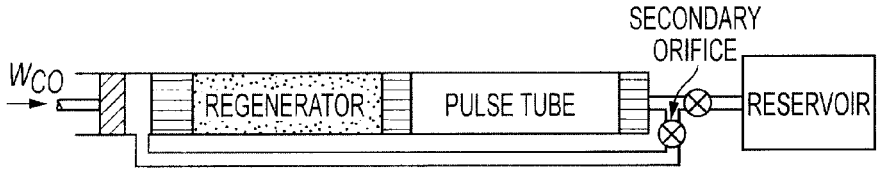
Figure 2C:
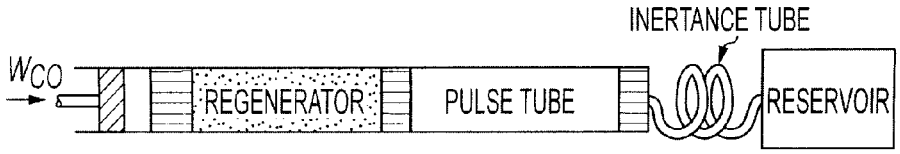

FIGS. 2(*a*)-2(*c*) illustrate schematics of three common phase shift mechanisms used for pulse tube cryocoolers. The orifice, shown in FIG. 2(*a*) is a purely resistive element, so the flow is in phase with the pressure at the orifice. Thus, this configuration provides no phase shift. As previously mentioned, such a phase will result in the phase at the cold end being about +30°. Such a phase leads to large regenerator losses and a low efficiency for the 4 K regenerator.

The second configuration in FIG. 2(*b*) shows a schematic of the double inlet method. Details as to this method are provided in Zhu, S., Wu, P., and Chen, Z., "Double inlet pulse tube refrigerators: an important improvement," *Cryogenics* 30, 1990, pp. 514-520. In this approach, the flow through the primary orifice is the sum (real and imaginary parts) of the flow through the pulse tube and the secondary orifice. Flow through the secondary orifice is in phase with the pressure drop across the regenerator, which, in turn, is approximately in phase with the regenerator flow at its midpoint. With the secondary orifice nearly closed, the regenerator midpoint flow and the secondary orifice flow will lead the pressure by about 40° to 50°. The pulse tube flow is then forced to lag the pressure to keep the flow through the primary orifice in phase with the pressure. However, as the secondary orifice flow is increased, additional compressor PV power is required to provide the extra flow. At some point the extra compressor power cancels the beneficial effect of a more favorable phase in the regenerator. Analyses show the overall efficiency peaks when the pulse tube warm end phase is about −30°, which gives a cold end phase of about 0°. The secondary orifice is generally made with two opposing needle valves to provide an asymmetric flow impedance that eliminates DC flow.

If the pulse tube warm end is at 30 K, then the double inlet normally must be at that temperature. The use of two needle valves at 30 K greatly complicates the operation and/or control of the system. The secondary orifice could be located at room temperature if a small secondary regenerator is placed between it and the pulse tube warm end at 30 K. The other side of the secondary orifice would be connected to the transfer line at room temperature between the compressor and the aftercooler. As far as is known, because a secondary regenerator has never been utilized before, such a configuration was investigated and modeled as discussed herein, in an effort to optimize the system. The use of a secondary regenerator is not an ideal solution, because the added gas volume reduces the possible phase shift. The flow impedance of the secondary regenerator could be made high enough to provide most of the impedance, and the room temperature needle valves would be used only to provide a small amount of adjustment to the overall impedance.

Often the primary orifice in a double inlet configuration is replaced with an inertance tube, even when it provides only a few degrees of phase shift. These few degrees add to the phase shift that the double inlet can provide as compared with the primary orifice being a simple orifice.

Figure 3:
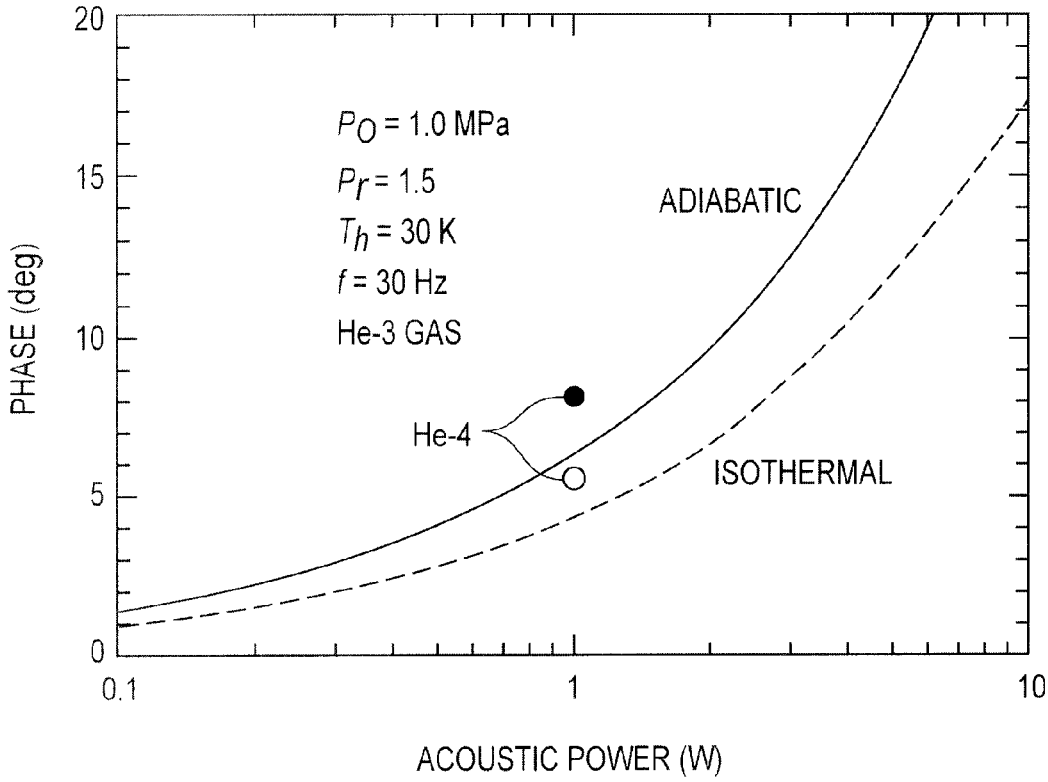
FIG. 3 is a graph of calculated phase of inertance tube impedance at 30 K with a large reservoir.

The inertance tube, as shown schematically in FIG. 2(*c*), is the most common method for phase shifting in Stirling-type pulse tube cryocoolers. For single stage pulse tube cryocoolers, the acoustic power entering the inertance tube is often high enough to provide an ideal phase shift of about −60° at the entrance to the inertance tube. For multiple stage pulse tube cryocoolers, the acoustic power flow in the colder stages is significantly less, which in many cases is insufficient to provide the desired phase shift with inertance tubes when used at room temperature. By placing the inertance tube and reservoir at a lower temperature, the higher gas density allows for a greater phase shift in the inertance tube. A transmission line model was used to calculate the maximum phase shift possible in a 30 K inertance tube driven at a frequency of 30 Hz, an average pressure of 1.0 MPa, and a pressure ratio of 1.5. These operating conditions were found to be near optimum for a 4 K regenerator. FIG. 3 shows the results of these calculations for both an adiabatic model and an isothermal model using $^3$He and $^4$He. For small acoustic powers (near 0.1 W) the radius of the inertance tube can become comparable to the thermal penetration depth (81 μm), in which case the isothermal model is more accurate. At 1 W of acoustic power, the ratio of inertance tube radius to thermal penetration depth is 4.3, in which case the phase shift will be close to that predicted by the adiabatic model. From FIG. 3, it can be seen that the maximum phase shift for $^3$He with 1 W of acoustic power at 30 K is only about 5°, rather than the desired 60°.

Mechanical Phase Shifters

Figure 4A:
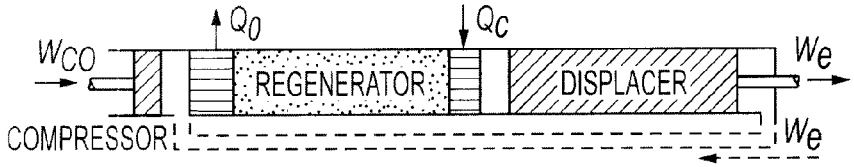
FIGS. 4(*a*)-4(*b*) are schematic illustrations of known mechanical phase shift mechanisms used in regenerative cryocoolers.
Figure 4B:
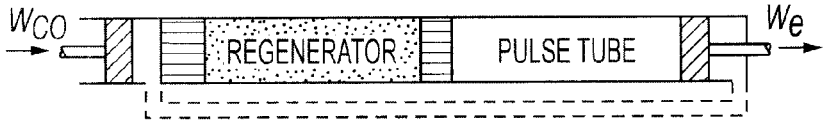

FIG. 4 illustrates schematics for various mechanical phase shift mechanisms that are used in regenerative cryocoolers. The first configuration shown in FIG. 4(*a*) is the displacer, which is used in Stirling or Gifford-McMahon cryocoolers. Any desired phase shift can be obtained with such a device when it is driven mechanically or electrically. The back side of a displacer has a small gas volume and is connected to the warm end of the regenerator to feed back the recovered expansion work. Alternatively, a piston could be used at the cold end with a large backside volume at the average pressure. The recovered work could be fed electrically or mechanically to room temperature where it can be dissipated as heat, but with some reduction in system efficiency because of the lost work. Such a displacer or expander requires a moving part at the cold end.

With the second configuration shown in FIG. 4(*b*), a pulse tube is inserted between the cold end and the displacer or expander at the warm end. The acoustic power entering the cold end of the pulse tube is transmitted through the pulse tube with no change (ideally) to provide expansion work at the pulse tube warm end. Ideally, the cooling power at the cold end is the same whether the displacer or expander is at the cold end or the warm end. With a warm displacer the backside is connected to the regenerator warm end to recover the work. With a warm expander there is no connection to the regenerator warm end, and the work is generally dissipated at room temperature in the form of heat. This second configuration still requires a moving part in the cold head, but the moving part is at the warm end of the pulse tube. For a single stage cryocooler, the moving part would be operating at room temperature. For a multiple stage cryocooler, the warm end of the lower stages may be at the cold temperature of the preceding stage.

Ideally, for certain applications, it would be desirable to place an expander at the warm end of the 4 K pulse tube. The expansion work could be used to drive a linear alternator whose electrical output power is either fed to room temperature to be dissipated as heat or is used to provide electrical power to drive low power superconducting electronics at 4 K. The later strategy eliminates the conduction loss in electrical leads at the higher stages. The low electrical resistivity of copper at 30 K also means that the Joule heating in the alternator would be very small compared to the recovered mechanical power. Such an expander and alternator could be in the form of a commercial pressure oscillator run in reverse to provide power instead of supplying the pressure oscillator with power. Unfortunately, most commercial pressure oscillators are not designed to operate at cryogenic temperatures. A specially designed expander would need to be developed for use at about 30 K to use it at the warm end of a 4 K pulse tube. A second, and much more convenient option, is to use a commercial pressure oscillator as an expander at room temperature, but couple the pressure oscillator to the 30 K pulse tube warm end by a secondary regenerator or a secondary pulse tube. A commercial pressure oscillator can be controlled electrically to provide any phase shift within the bounds of its swept volume and maximum current. A linear motor can generate electric power from the recovered PV power, or electric power input may be required if the expander is operating far from resonance and the Joule heating is larger than the generated power.

Secondary Regenerators and Pulse Tubes

Operating Procedure

Figure 5B:
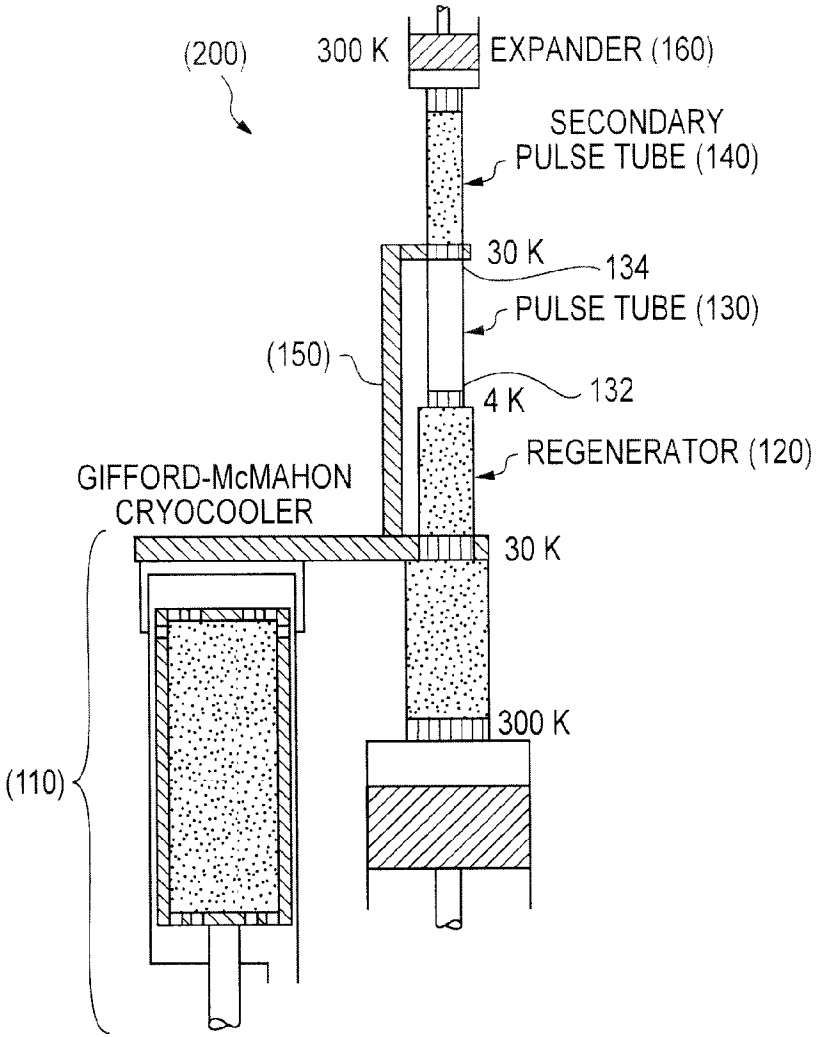
FIGS. 5(*a*)-5(*b*) are schematic illustrations of two preferred embodiment cooling systems in accordance with the present invention.
Figure 5A:
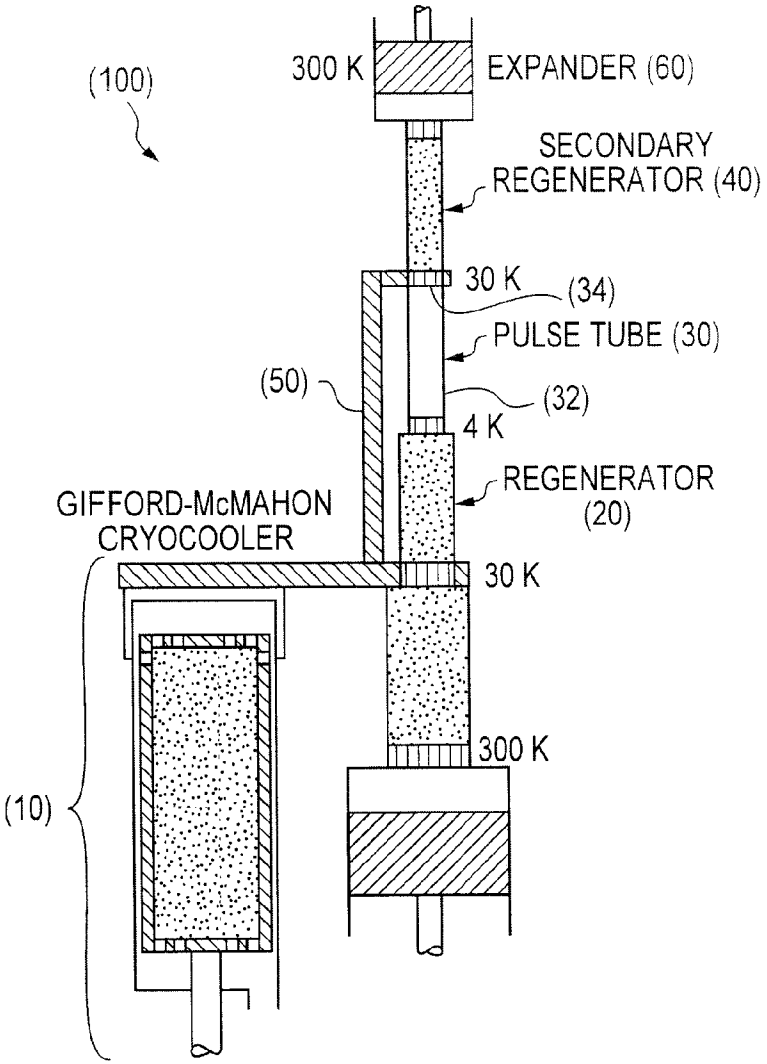

FIG. 5 schematically illustrates two preferred embodiment cooling systems in accordance with the invention. These figures depict secondary regenerators and pulse tubes and their incorporation into a multiple stage cryocooler to reach 4 K. In the noted figures (described in greater detail below), a Gifford McMahon cryocooler is shown for the precooling to about 30 K, but pulse tube or Stirling cryocoolers could also be used. The purpose of both the secondary regenerator and the secondary pulse tube is to transmit acoustic power from the cold end to the warm end with a minimum pressure drop. Any pressure drop in either of these components would represent a resistive element with flow in phase with the pressure drop. Such a pressure drop would diminish the phase shift possible with the expander. Other parameters used in the optimization are the gas volume in the element and the enthalpy flow. As the gas volume is increased, the flow amplitude at the expander is increased, which requires a greater swept volume. Time-averaged enthalpy flow toward the cold end would generate heat in the heat exchanger at the warm end of the primary pulse tube. That heat then needs to be removed by the precooling stage. Ideally, it would be beneficial that the enthalpy flow be from the 30 K end to ambient temperature and be as large as possible. It is surprising that a secondary regenerator has an enthalpy flow toward the cold end, even though the acoustic power flow is toward the warm end. However, in a secondary pulse tube the enthalpy flow can easily be toward the hot end. If that enthalpy flow is the same as that in the primary pulse tube, then no heat needs to be absorbed at the 30 K heat exchanger. In principle, that case would not require any heat exchanger, and the two pulse tubes become a single pulse tube that is connected between 4 K and ambient temperature. Usually a single pulse tube will be less efficient and not be able to transmit as much enthalpy flow from the 4 K cold end.

A fundamental difference between the secondary regenerator and the secondary pulse tube is that the regenerator behaves nearly like an isothermal element, which amplifies acoustic power proportional to the temperature. Thus, the volume flow rate also increases with temperature and a larger expander is required at room temperature compared with one that might operate at 30 K. The secondary pulse tube operates nearly like an adiabatic element, which transmits acoustic power from cold to hot with no amplification. Therefore, a secondary pulse tube is preferred, because a smaller swept volume is required of the expander.

Specifically, FIG. 5(*a*) depicts a preferred embodiment pulse tube cooling system 100 in accordance with the invention. The cooling system 100 comprises a cryocooler 10. Although the cryocooler is noted as a Gifford-McMahon cryocooler, it will be understood that other cryocoolers can be utilized in the system 100. The preferred pulse tube cooling system 100 also comprises a regenerator 20 and a pulse tube 30. The pulse tube 30 defines a cold end 32 and a warm end 34. The regenerator 20 is disposed between and in fluid or thermal communication with the cold end of the cryocooler 10 and in fluid communication with the cold end 32 of the pulse tube 30. A thermal link 50 is preferably used to provide thermal communication between the warm end 34 of the pulse tube 30 and the cryocooler 10. The preferred embodiment pulse tube cooling system 100 also comprises a secondary regenerator 40 and an expander 60. The secondary regenerator 40 is disposed between and in fluid communication with the warm end 34 of the pulse tube 30 and the expander 60.

Specifically, FIG. 5(*b*) depicts a preferred embodiment pulse tube cooling system 200 in accordance with the invention. The cooling system 200 comprises a cryocooler 110. Although the cryocooler is noted as a Gifford-McMahon cryocooler, it will be understood that other cryocoolers can be utilized in the system 200. The preferred pulse tube cooling system 200 also comprises a regenerator 120 and a pulse tube 130. The pulse tube 130 defines a cold end 132 and a warm end 134. The regenerator 120 is disposed between and in fluid or thermal communication with the cold end of the cryocooler 110 and in fluid communication with the cold end 132 of the pulse tube 130. A thermal link 150 is preferably used to provide thermal communication between the warm end 134 of the pulse tube 130 and the cryocooler 110. The preferred embodiment pulse tube cooling system 200 also comprises a secondary pulse tube 140 and an expander 160. The secondary pulse tube 140 is disposed between and in fluid communication with the warm end 134 of the pulse tube 130 and the expander 160.

Modeling Procedure

The software REGEN3.3 was used to model both the secondary regenerator and the secondary pulse tube. The software uses a finite difference technique to evaluate the four conservation equations in a regenerator. The software was designed to model a normal cryocooler regenerator in which the acoustic power flow is from the hot end to the cold end. Details as to this software are provided in Radebaugh, R., Huang, Y., O'Gallagher, A., and Gary, J., "Optimization Calculations for a 30 Hz 4 K Regenerator with Helium-3 Working Fluid," *Adv. Cryogenic Engineering*, Vol 55, Amer. Inst. of Physics, New York, 2010, pp. 1581-1592. It was determined that the software is also useful in modeling regenerators with the power flow in the opposite direction. The only change required in the input conditions is to add 180° to the phase of the cold end mass flow with respect to the pressure. That change causes the acoustic power flow to travel from the cold to the hot end of the regenerator.

The software has not been used in the past to model pulse tubes, because the software was not designed for that task. However, with the ability to have acoustic power travel from the cold end to the hot end, it was decided to try modeling the secondary pulse tube. The friction factor and heat transfer coefficient are calculated at each time increment and at each grid point in the regenerator from the steady-state correlations of Kays and London. These correlations are described in Kays, W. M., and London, Compact Heat Exchangers, Third Edition, McGraw-Hill, 1984. Such correlations should be useful for oscillating flow in regenerators where the amplitude of gas motion is much larger than the hydraulic diameter and the hydraulic diameter is less than the viscous penetration depth. The latter condition means the Valensi number is less than 1. Those conditions usually do not hold in pulse tubes. The Valensi number for the pulse tubes of interest here are on the order of 100. The Valensi number Va is approximately equal to the squared ratio of the tube inner radius to the viscous penetration depth, as given by formula (3):

$$Va = \frac{r^2 \rho \omega}{\mu}, \tag{3}$$

where r is the inner radius, ρ is the gas density, is the angular frequency, and ω is the dynamic viscosity. For such high Valensi numbers, the friction factor and the heat transfer coefficient should be higher than those determined from steady state correlations. These correlations are described in Garaway, I., Grossman, G., "Studies in High Frequency Oscillating Compressible Flow for Application in a Micro Regenerative Cryocooler," *Adv. Cryogenic Engineering*, Vol. 51, American Institute of Physics, New York, 2006, pp. 1588-1595. Because the pressure drop in the pulse tube is so small, the difference has no significant effect on most of the modeling described herein. The higher heat transfer coefficient may affect the calculation of the enthalpy flow within the pulse tube. The enthalpy results noted were used to understand general trends. However, care was taken to not rely heavily on the absolute values.

The parameters used for the modeling discussed here are given in Table 1, set forth below. All of the calculations are with $^4$He working fluid. Because of the relatively high temperature (30 K to 300 K) and the low pressure (1.0 MPa), real gas effects should be small. Thus, no significant differences are expected if $^4$He were to be replaced with $^3$He. For the secondary regenerator, a 6 mm diameter stainless steel tube was modeled that was filled with various mesh sizes of stainless steel screen to achieve different hydraulic diameters. Hydraulic diameters greater than about 100 μm are not practical for actual regenerators, but values up to the tube diameter were used in the calculations to observe the effect of hydraulic diameter. The porosity was kept constant at 0.68, and the cold end mass flow rate was held constant at 0.32 g/s for all values of hydraulic diameter. For the secondary pulse tube modeling, the tube diameter and the flow were varied in such a manner that the ratio of cross-sectional area to the cold end mass flow remained constant. The relative penetration of the gas at the cold end varied from about 0.18 to 0.25. The porosity was set at 0.91 to account for a thin wall.

TABLE 1

Parameters for the Secondary Regenerator and Pulse Tube Used for the Modeling Discussed Herein.

| Secondary Element | $T_c$ (K) | $T_h$ (K) | $P_0$ (MPa) | $P_r$ | $m_c$ (g/s) | $\phi_c$ (deg) | D (mm) | L (mm) | $A_g/m_c$ ($cm^2$-s/g) |
|---|---|---|---|---|---|---|---|---|---|
| Regenerator | 30 | 300 | 1.0 | 1.3 | 0.32 | −60 | 6.0 | 50 | 0.62 |
| Pulse Tube | 30 | 300 | 1.0 | 1.3 | — | −60 | 0.5-6.0 | 50 | 0.79 |

Modeling Results

Figure 6:
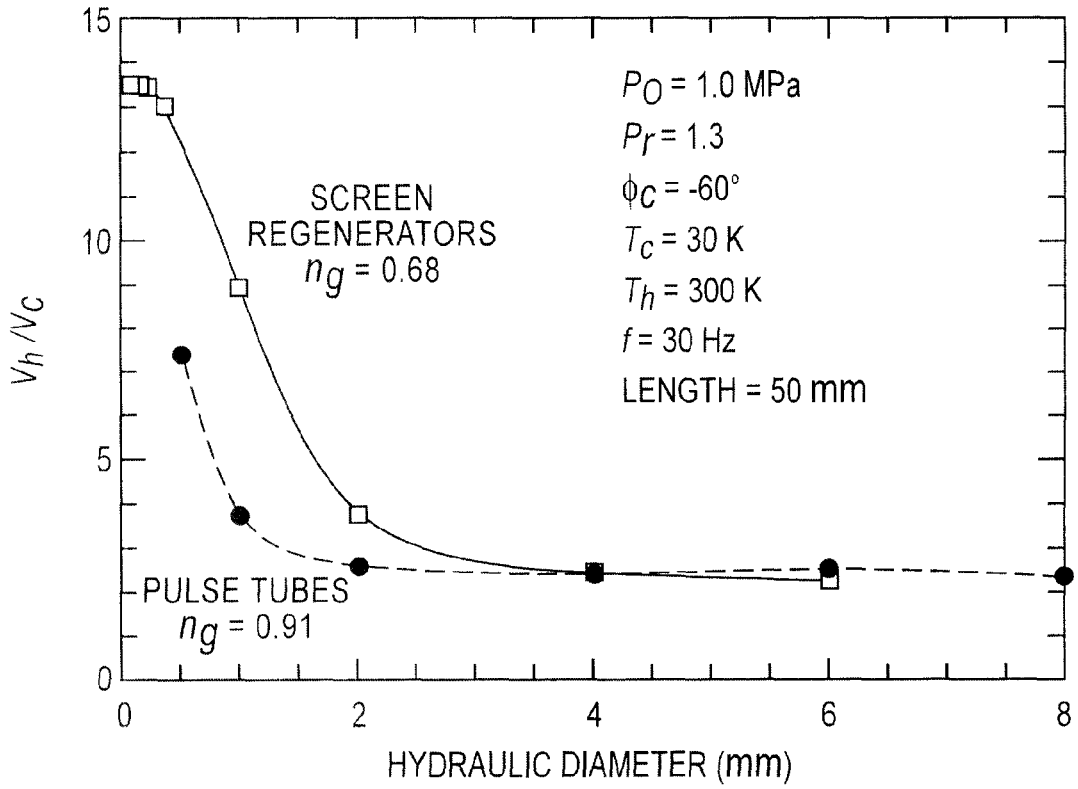
FIG. 6 is a graph of ratios of hot to cold swept volumes in secondary regenerators and pulse tubes.
Figure 7:
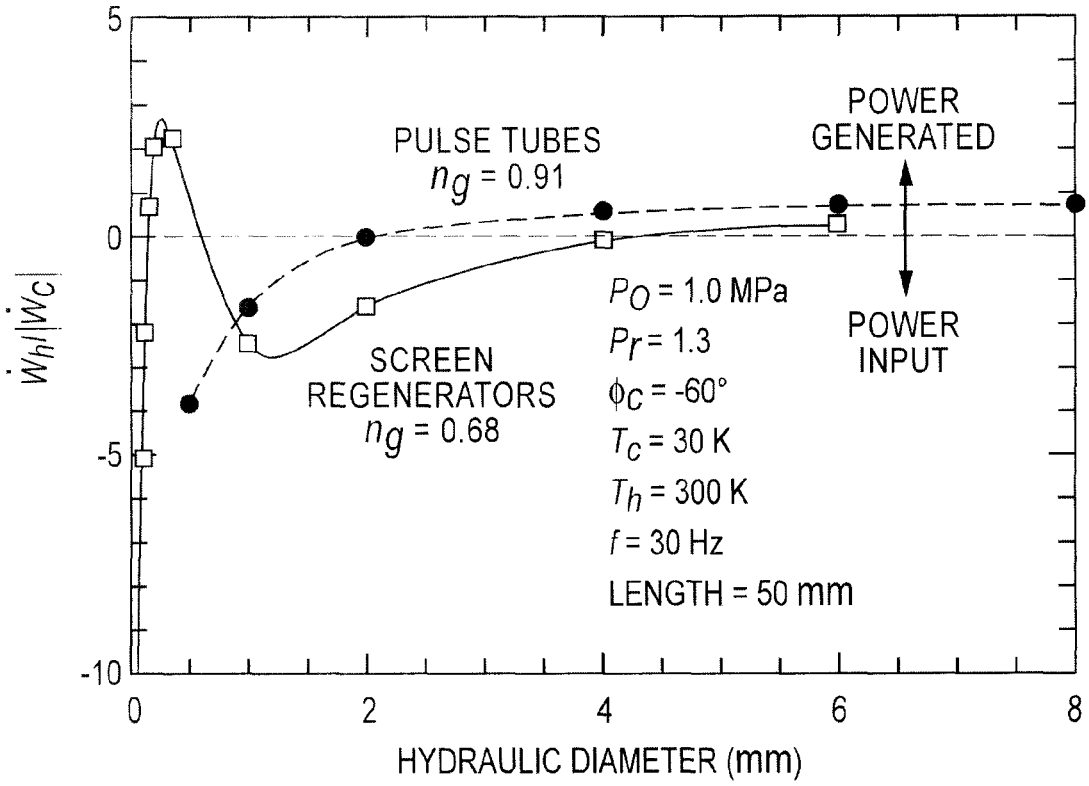
FIG. 7 is a graph of ratios of hot to cold PV powers in secondary regenerators and pulse tubes.

FIG. 6 shows the results of the REGEN3.3 calculations for the ratio of the swept volume at the warm ends of secondary regenerators and pulse tubes to that at the cold ends. The regenerators were filled with stainless steel screens of various hydraulic diameters of porosity 0.68. The pulse tube diameters (equal to the hydraulic diameter) were varied but with a constant porosity of 0.91 to account for heat transfer to a thin wall. Secondary regenerators with hydraulic diameters less than about 100 μm (typical of good regenerators) show a rather high swept volume ratio of about 14, whereas the secondary pulse tubes have a ratio of about 2.5 for diameters of 2 mm and larger. This low swept volume ratio shows the advantage of using a secondary pulse tube compared to a secondary regenerator to couple to a warm expander at room temperature. The amount of PV power that the expander needs to extract or input to the gas can be determined from the ratio of the warm PV power to the cold PV power shown in FIG. 7. Because PV power must be input to the gas at the cold end to drive the acoustic power toward the warm end, the sign of this cold PV power is considered negative. For that reason, the absolute value of the cold end PV power was used in the denominator, so the ratio reflects the sign of the warm end PV power. A positive value for this ratio then means that power must be extracted from the gas at the warm end. Ideally, it would be expected that power is extracted in all cases, but referring to FIG. 7, it is clear that there are some cases where the ratio is negative and power must be input at the warm end.

Figure 8:
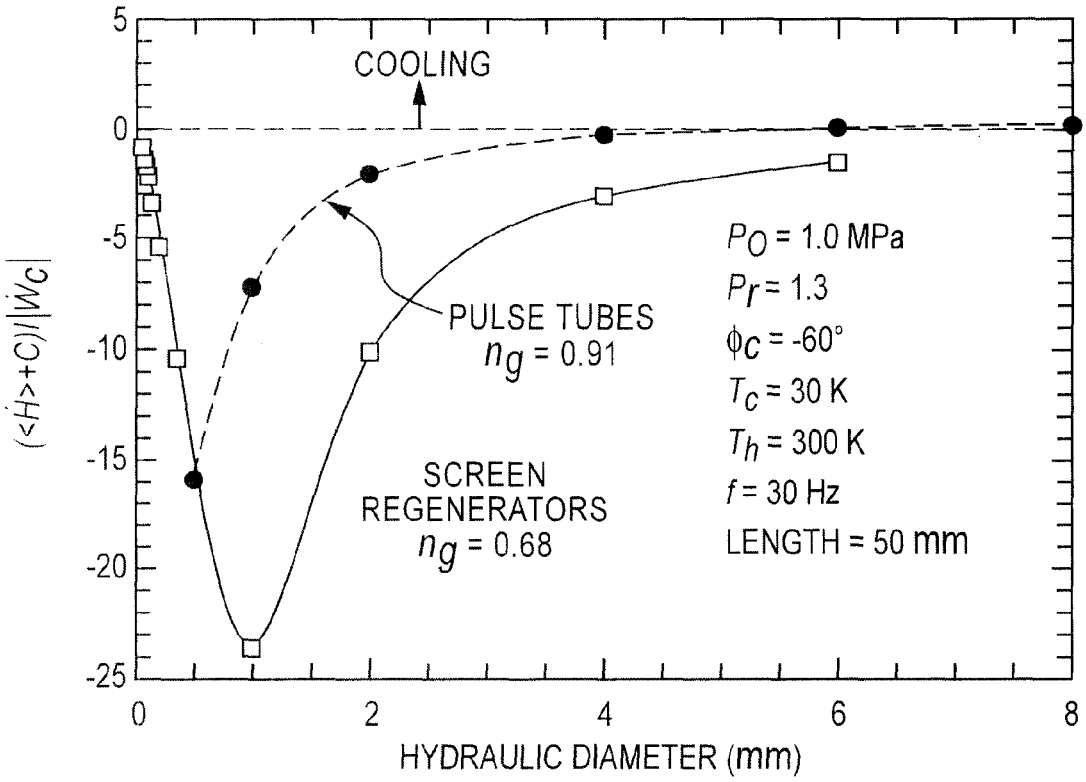
FIG. 8 is a graph of calculated ratio of enthalpy plus conduction flow to the absolute value of cold end acoustic power.

An important parameter of the secondary regenerator or pulse tube is the heat load or heat lift that such component imposes upon the primary pulse tube warm end. The heat load is given by the sum of the time-averaged enthalpy flow and the thermal conduction in the secondary element. In analyses of entire pulse tube cryocoolers, a positive enthalpy flow is generally meant to be a flow from the compressor to the expander. That convention is maintained and a positive enthalpy and conduction flow is believed to occur from the cold end to the warm end of the secondary regenerator or pulse tube. A positive value then means a cooling effect. FIG. 8 shows the calculated enthalpy plus conduction divided by the absolute value of the cold end power flow for both the secondary regenerator and the secondary pulse tube. The energy flow (enthalpy plus conduction) is negative for most cases, which means a heat load to the 30 K heat exchanger. For a typical secondary regenerator configuration with a small hydraulic diameter, the heat load as shown in FIG. 8 is fairly small. For larger hydraulic diameters, the heat load becomes quite large until the hydraulic diameter becomes much larger than the thermal penetration depth, at which point the heat load begins to behave more like an adiabatic element and converge with the secondary pulse tube behavior.

Figure 9:
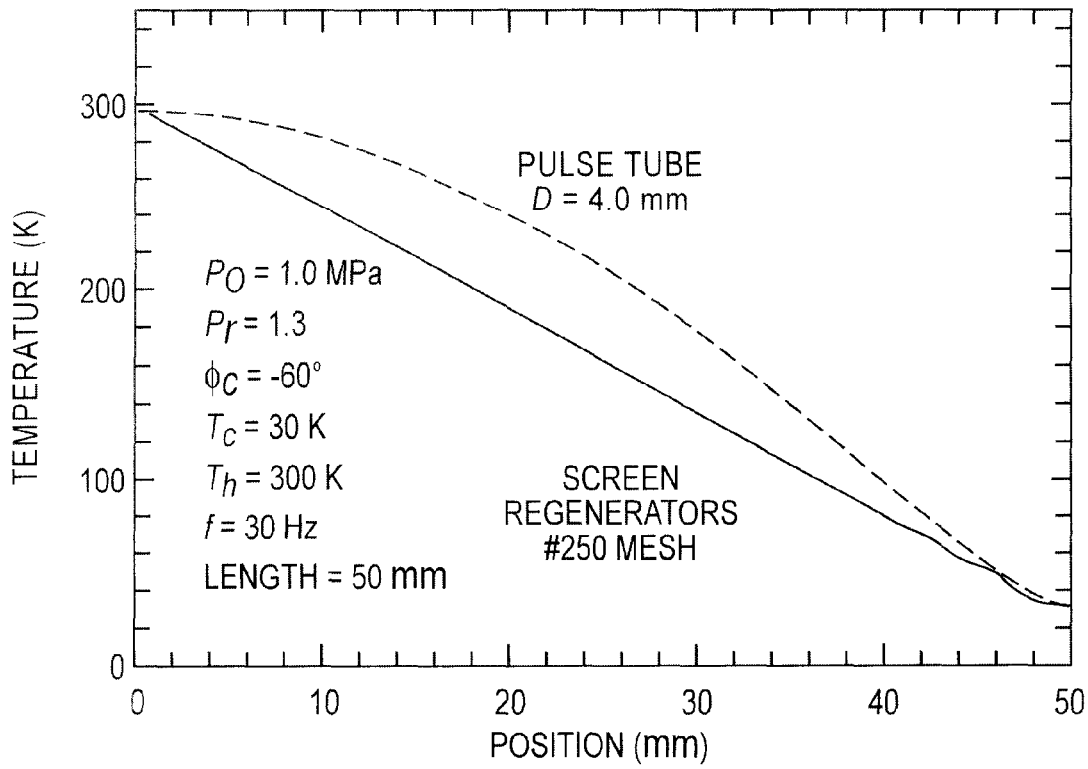
FIG. 9 is a graph of calculated temperature profiles for a typical secondary regenerator and pulse tube.

The calculated temperature profile for a secondary regenerator with a 64 μm hydraulic diameter (#325 mesh) and a 4.0 mm diameter secondary pulse tube are shown in FIG. 9. The large phase angles between flow and pressure in these elements give rise to the upward bending temperature profile. This behavior suggests that heat sinking either element at approximately the midpoint to an 80 K first stage could significantly reduce the heat load at 30 K, and potentially result in a cooling effect at 30 K with the secondary pulse tube when there is a heating effect without the heat sink.

Impedance Matching to Room Temperature Expander

Linear Compressor Modeling

Figure 10:
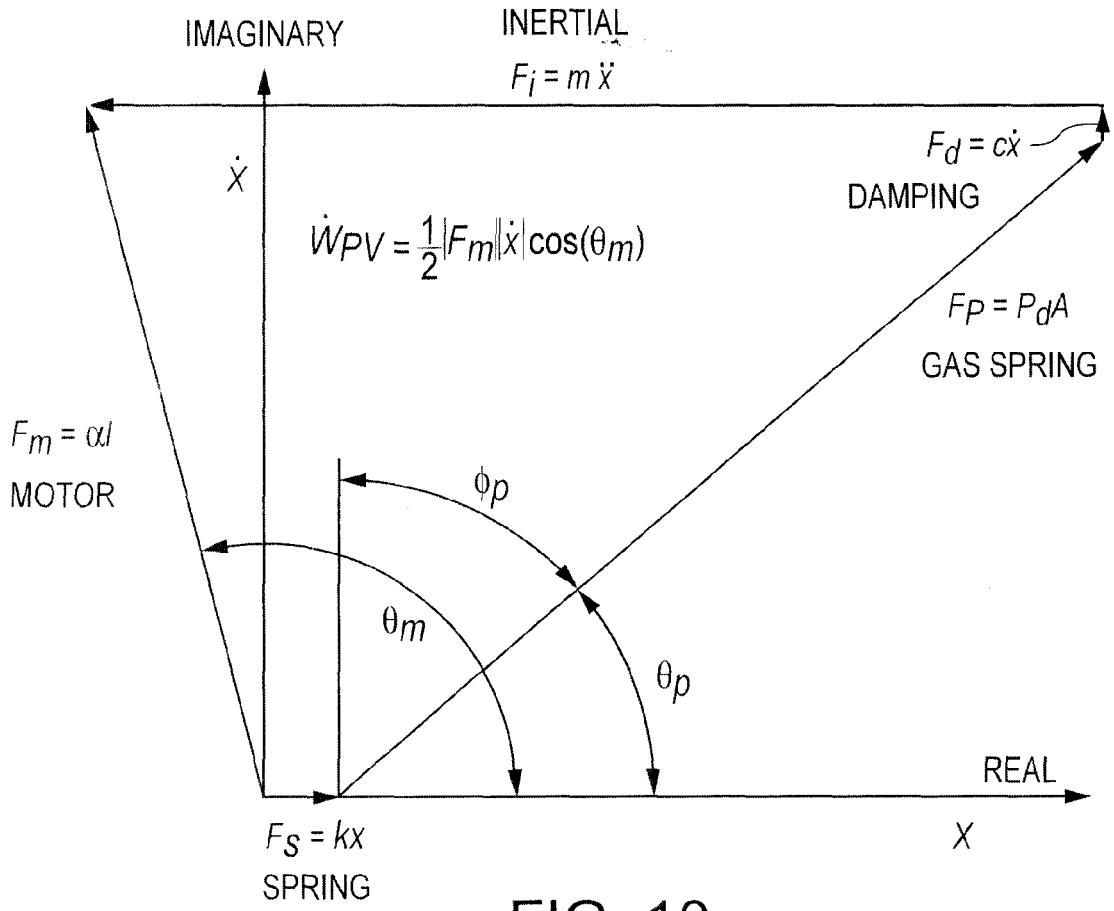
FIG. 10 is a linear compressor phasor diagram.

For small 4 K refrigeration powers, a small linear compressor would be able to provide the function of a linear expander. An important property of the compressor is that its swept volume should be a close match to the required swept volume to eliminate excessive void volume, which requires a larger swept volume to extract the same amount of PV power. The behavior of a linear compressor can be modeled by constructing a force balance, where the motor force must balance the forces due to the mechanical spring, pressure, damping, and inertia. FIG. 10 shows a general phasor diagram for such a force balance. All of the forces, except the motor force, are shown as the negative of the actual forces generated by the mechanical spring, gas pressure, damping, and inertia. Their sum is shown equal to the required motor force. The highest compressor efficiency is achieved for a given pressure phasor when the motor phasor is parallel to the velocity ($\theta_m$=90°). That condition, known as resonance, provides a given PV power with the minimum current or Joule heating. High efficiency in an expander is not so important, because the PV power needs to be dissipated in the form of heat. With an inefficient expander, that dissipation occurs within the motor coil rather than in an external resistor. Because the extracted PV power is only about 1 W for a low power 4 K cryocooler, there is very little to be gained by feeding that back into the aftercooler where several hundred watts of PV power are being fed into the system by the main compressor.

Linear Expander Modeling

Figure 11:
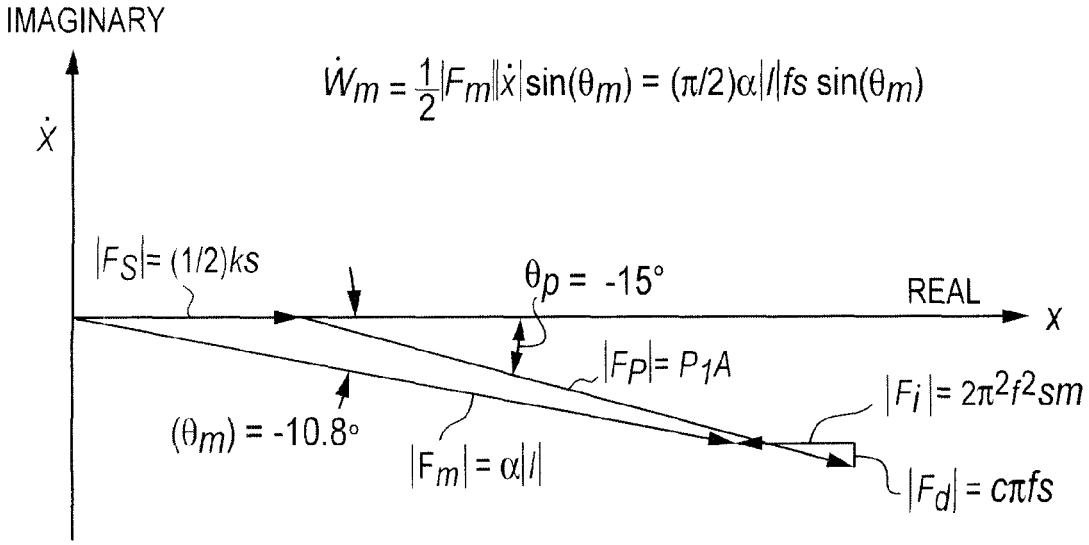
FIG. 11 is a representative phasor diagram of a linear expander.

For the example considered herein, the smallest commercially available linear compressor is used as the expander for the analysis. Table 2 set forth below, gives the parameters of this linear compressor needed for modeling it as an expander. FIG. 11 shows the force balance for a typical case where the following conditions apply: Average pressure is 1.0 MPa; pressure ratio is 1.3; frequency is 30 Hz; PV power extracted is 1.0 W; and phase between mass flow and pressure is −75° ($\theta_p$=−15°). Because the expander is operating far from its resonance condition, a fairly large motor current is required. The resulting Joule heat of 2.0 W and damping power of 0.15 W exceeds the extracted 1 W of PV power, so 1.15 W of electrical power must be applied to the expander. With this example the swept volume is 72% of the 0.567 $cm^3$ maximum. A PV power of 1 W at 30 K with flow lagging pressure by 60° requires a swept volume of 0.31 $cm^3$.

TABLE 2

Parameters of Linear Compressor Used for Modeling as an Expander.

| Piston Dia (mm) | Pk-pk stroke s (mm) | Moving mass m (g) | Spring const. k (N/m) | Force const. α (N/A) | Damp. coeff. c (N · s/m) | Coil resist. R (Ω) |
|---|---|---|---|---|---|---|
| 9.5 | 8.0 | 30 | 2000 | 5.0 | ~1 | 0.36 |

Systems

The preferred embodiment cooling systems generally comprise a compressor or cryocooler, a regenerator, a pulse tube, a secondary component as described herein, and an expander. As will be understood, these components are in fluid communication with one another such that a working fluid can be transferred between the components. The pulse tube generally defines a cold end which can be from about 20 K to about 4 K, and most preferably about 4 K. The pulse tube also defines a warm end which is typically from about 60 K to about 20 K, and most preferably about 30 K. The secondary component is preferably either a secondary regenerator or a secondary pulse tube. The secondary component is preferably in direct fluid communication with the warm end of the pulse tube. The expander is preferably a pressure oscillator and most preferably operated at ambient temperature. In such configurations, the pressure oscillator can be commercially available pressure oscillator. It will be understood that the expander or pressure oscillator serves as a phase shifter component.

In addition to the preferred embodiment two stage cooling systems described herein, the invention includes an array of multistage pulse tube cooling systems. For example, a three stage pulse tube cooling system utilizing one or two secondary regenerators and/or secondary pulse tubes is contemplated.

Additional details and background information concerning cryocoolers, pulse tube cooling systems and the like are provided in U.S. Pat. Nos. 6,205,812; 6,644,038; and 6,389,819. Additional information is also provided by Radebaugh, "Development of the Pulse Tube Refrigerator as an Efficient and Reliable Cryocooler," Proc. Institute of Refrigeration, 1999-2000, p. 1-27.

CONCLUSIONS

Stirling-type pulse tube cryocoolers for operation at 4 K require the flow at the cold end to lag the pressure by about 30° to provide the maximum COP for the 4 K regenerator and to enable the cryocooler to operate reasonably efficient. An inertance tube at the 30 K warm end of the 4 K stage can not provide sufficient phase shift when the operating frequency is about 30 Hz or higher. Thus, a warm expander is required to provide the ideal phase shift. Commercial linear compressors can be used as the expander if they can operate at such low temperatures. As described herein, it has been demonstrated that such an expander can also be used at room temperature to provide the required phase shift, but then a secondary pulse tube or secondary regenerator is preferably placed between the warm end (at about 30 K) of the 4 K pulse tube component and the room temperature expander. A smaller expander swept volume is required when a secondary pulse tube is used as opposed to a secondary regenerator. Further investigations with a secondary regenerator and a room temperature expander have shown improved performance compared with what can be achieved with an inertance tube at 30 K. Impedance matching to the linear expander at room temperature is not very important as long as the expander has sufficient swept volume to provide the necessary phase shift between flow and pressure.

Many other benefits will no doubt become apparent from future application and development of this technology.

All patents, published applications, and articles noted herein are hereby incorporated by reference in their entirety.

It will be understood that any one or more feature or component of one embodiment described herein can be combined with one or more other features or components of another embodiment. Thus, the present invention includes any and all combinations of components or features of the embodiments described herein.

As described hereinabove, the present invention solves many problems associated with previously known systems and devices. However, it will be appreciated that various changes in the details, materials and arrangements of parts, which have been herein described and illustrated in order to explain the nature of the invention, may be made by those skilled in the art without departing from the principle and scope of the invention, as expressed in the appended claims.

What is claimed is:

1. A pulse tube refrigeration system comprising:

a compressor;

a regenerator in fluid communication with the compressor;

a pulse tube defining a cold end and a warm end, the regenerator being in fluid communication with the cold end of the pulse tube; and a secondary component selected from (i) a secondary regenerator and (ii) a secondary pulse tube, wherein the secondary component is in fluid communication with the warm end of the pulse tube; and an expander in fluid communication with the secondary component;

wherein the regenerator is disposed directly between the compressor and the cold end of the pulse tube, and the secondary component is disposed directly between the expander and the warm end of the pulse tube.

2. The pulse tube system of claim 1 wherein the secondary component is a secondary regenerator.

3. The pulse tube system of claim 1 wherein the secondary component is a secondary pulse tube.

4. The pulse tube system of claim 1 wherein the expander is a pressure oscillator.

5. The pulse tube system of claim 1 wherein the expander is at ambient temperature.

6. The pulse tube system of claim 1 wherein the warm end of the pulse tube is at 30 K.

7. The pulse tube system of claim 1 further comprising a working fluid in communication with the compressor, the regenerator, the pulse tube, the secondary component, and the expander.

8. The pulse tube system of claim 7 wherein the working fluid is selected from the group consisting of $^{3}He$ and $^{4}He$.

9. The pulse tube system of claim 1 wherein the cold end of the pulse tube is at 4 K.

* * * * *